US006016775A

United States Patent [19]

Kennedy

[11] Patent Number: 6,016,775

[45] Date of Patent: Jan. 25, 2000

[54] TWO-CYLINDER HEAD AND NARROW VEE-TYPE INTERNAL COMBUSTION ENGINE INCLUDING SAME

[75] Inventor: Lawrence Charles Kennedy, Bingham Farms, Mich.

[73] Assignee: Detroit Diesel Corporation, Detroit, Mich.

[21] Appl. No.: 09/151,237

[22] Filed: Sep. 14, 1998

[51] Int. Cl.[7] ..... F02F 7/00

[52] U.S. Cl. ..... 123/54.4; 123/193.5

[58] Field of Search ..... 123/54.4, 54.5, 123/54.6, 54.7, 54.8, 193.5, 193.3

[56] References Cited

U.S. PATENT DOCUMENTS

| | | | |
|---|---|---|---|
| 1,531,430 | 3/1925 | Wrentmore | 123/54.7 |
| 4,194,469 | 3/1980 | Kruger . | |
| 4,696,262 | 9/1987 | Roggendorff . | |
| 4,787,342 | 11/1988 | Matsumori et al. . | |
| 5,438,963 | 8/1995 | Tsunoda et al. | 123/54.4 |
| 5,553,586 | 9/1996 | Koishikawa et al. | 123/54.4 |
| 5,622,143 | 4/1997 | Fuoss et al. . | |

*Primary Examiner*—Marguerite McMahon
*Attorney, Agent, or Firm*—Bill C Panagos

[57] ABSTRACT

A two-cylinder head is provided for use in a narrow vee-type internal combustion engine. A vee-type internal combustion engine which includes at least one such two-cylinder head is also provided. The two-cylinder head includes a pair of liner flange counterbores which cover a pair of engine cylinders. The liner flange counterbores are staggered relative to, and overlap, a head centerline, and each include exhaust and intake ports which are a mirror image of each other. A respective exhaust passage extends from each exhaust port to the same exhaust manifold mounting face which extends at an angle relative to the head centerline.

20 Claims, 7 Drawing Sheets

TWO-CYLINDER HEAD AND NARROW VEE-TYPE INTERNAL COMBUSTION ENGINE INCLUDING SAME

TECHNICAL FIELD

The present invention relates to a two-cylinder head for use in a narrow vee-type internal combustion engine, and a narrow vee-type internal combustion engine which includes at least one such two-cylinder head attached to an engine block.

BACKGROUND ART

Vee-type internal combustion engines include at least two cylinders arranged in a vee-type configuration, each cylinder being rotated a transverse angle from a vertical engine centerline, in an amount equal to one half of a bank angle. For example, a conventional vee-type internal combustion engine may comprise a first bank which comprises a first plurality of in-line cylinders and a second bank which comprises a second plurality of in-line cylinders, each bank extending in the direction of a longitudinal axis which extends from one end of the internal combustion engine to the opposite end thereof, the cylinders in opposite banks forming a vee-shape configuration. In order to provide serviceability, a conventional cylinder liner having a flange is inserted into each cylinder. Each liner flange is square with a respective cylinder bore, and the engine block and cylinder head mate with opposite surfaces of each liner flange to hold it in place. One or more conventional gaskets are positioned between the engine block and cylinder head to provide the usual sealing.

In designing a vee-type internal combustion engine, it is desirable to provide a structure which satisfies performance objectives and yet is relatively compact. For example, providing a narrow vee-type engine by reducing cylinder spacing in the direction of the longitudinal axis of the engine, would increase engine compactness. However, in vee-type engines, various considerations tend to limit. increasing the degree of compactness obtainable. For example, designing a cylinder head for use in a narrow vee-type internal combustion engine presents various problems. The use of an individual head for each cylinder is not desirable since it would be necessary to provide more than one head configuration. Further, an individual head pattern would create poor head bolt location choices. In addition, exhaust passages on each alternating head would be very long thereby contributing adversely to heat exchange characteristics. In the alternative, a cylinder head could be provided adjacent each bank of the engine, but such a configuration would be contrary to the objective of engine compactness in that two exhaust manifolds would be required. Further, milling of separate firedecks for each bank is generally not possible because the cylinder bores overlap into respective opposite firedecks. For modern diesel engines having direct fuel injection, however, it is desirable to orient each cylinder head firedeck within the combustion chamber so that the firedeck is perpendicular to the centerline of the cylinder, and to have the fuel injection nozzle located and oriented along the cylinder centerline. A full length, one piece cylinder head is also not desirable since the use of cylinder liners will require liner counterbores in the head and engine block, and in such a configuration dimensional variations that adversely affect compression seal load distribution become a problem.

A further consideration is that in prior art vee-type internal combustion engines, the engine exhaust port passages are typically coupled to an exhaust manifold at one or more interface surfaces which are parallel to the horizontal axis of the engine block. This feature in combination with conventional valve and intake port patterns effects a configuration which defines lengthy exhaust port passages which provide less than optimum heat transfer characteristics. In addition, in considering assembling vee-type internal combustion engines, problems exist relating to the need to compensate for tolerances of, and equalization of load distribution between, paired cylinder liner flanges. Further, while it is desirable to shorten exhaust passages to improve heat exchange characteristics, it is also necessary for the air induction system to be uniform for each cylinder so that the same swirl characteristics exist for all cylinders. In considering possible cylinder head configurations which address all of the foregoing concerns, it is also necessary to provide an exhaust and intake port pattern which satisfactorily accommodates pushrod and other valve operating mechanisms, head hole locations and cooling water jacket design. All of these considerations present problems in the manufacture of a head for a narrow vee-type internal combination engine.

DISCLOSURE OF THE INVENTION

It is an object of the present invention to provide a narrow vee-type internal combustion engine having improved compactness.

It is another object of the present invention to provide a narrow vee-type internal combustion engine wherein the cylinder spacing is substantially reduced in the direction of a horizontal axis of the engine.

It is a further object of the present invention to provide an improved two-cylinder head for use in achieving the foregoing objectives.

It is yet another object of the present invention to provide an improved two-cylinder head, for use in a narrow vee-type internal combustion engine, having opposite firedecks within the combustion chamber which are perpendicular to a respective cylinder centerline, and wherein a respective fuel injector nozzle is located and oriented along such cylinder centerline.

Another object of the present invention is to provide an improved two-cylinder head, for use in a narrow vee-type internal combustion engine, having individual liner flange counterbores, and a head/block joint surface which extends in a horizontal plane when the head is attached to the engine block.

A further object of the present invention is to provide an improved two-cylinder head, for use in a narrow vee-type internal combustion engine, which includes exhaust port passages of minimum length which improves heat transfer characteristics.

Yet another object of the present invention is to provide an improved two-cylinder head, for use in a narrow vee-type internal combustion engine, which includes features which provide automatic adjustment for tolerances during attachment of the head to an engine block.

Another object of the present invention is to provide an improved two-cylinder head, for use in a narrow vee-type internal combustion engine, which provides substantially equal load distribution to paired cylinder liner flanges.

This invention achieves these and other objectives by providing a two-cylinder head structured and arranged for attachment to a vee engine block having an engine centerline extending from a front of the engine block to a rear of the engine block. The two-cylinder head comprises a first liner flange counterbore structured and arranged to cover a first cylinder of a first bank of the engine block, and a second liner flange counterbore structured and arranged to cover a second cylinder of a second bank of the engine block. The first liner flange counterbore is staggered relative to the second liner flange counterbore along a head centerline, and the first liner flange counterbore and the second liner flange counterbore overlap the head centerline. The first liner flange counterbore includes one or more first exhaust port and a first pair of intake ports, and the second liner flange counterbore includes one or more second exhaust port and a second pair of intake ports. The one or more first exhaust port and the first pair of intake ports are a mirror image of the one or more second exhaust port and the second pair of intake ports, respectively, in relation to the head centerline. A respective first exhaust passage extends from each first exhaust port to an exhaust manifold mounting face, and a respective second exhaust passage extends from each second exhaust port to such exhaust manifold mounting face. The exhaust manifold mounting face extends at an angle to the head centerline.

A narrow vee-type internal combustion engine which includes such a two-cylinder head attached to an engine block is also provided.

BRIEF DESCRIPTION OF THE DRAWINGS

This invention may be clearly understood by reference to the attached drawings wherein like elements are described by like reference numerals and in which.

BEST MODE FOR CARRYING OUT THE INVENTION

In the preferred embodiment, the internal combustion engine of the present invention comprises some conventional features of an inline-type, direct fuel injected diesel engine including evenly spaced cylinders, no sharing of crankpins, one connecting rod being provided per crankpin, and a full compliment of main bearings which provide main bearing support between each cylinder. Such features are well known in the art and are not described herein.

Figure 1:
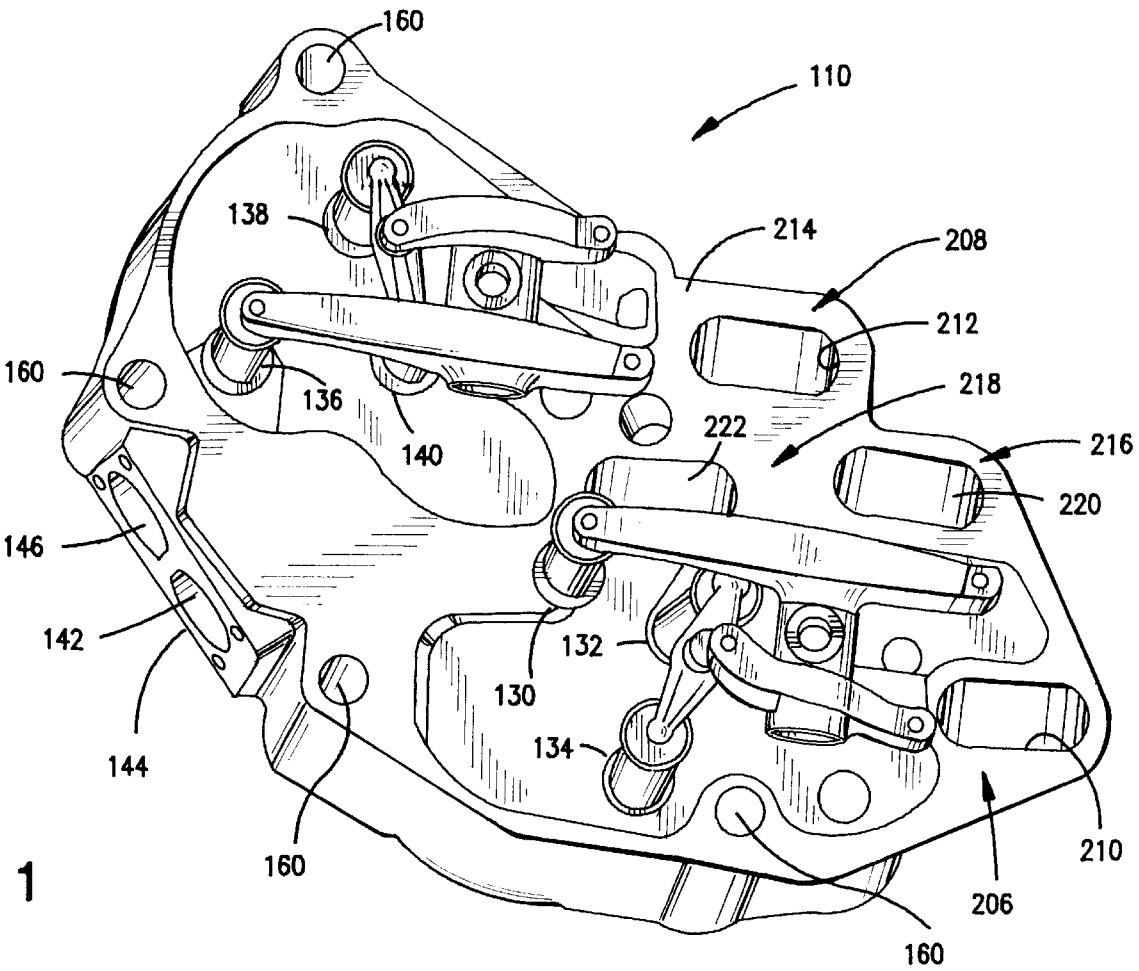
FIG. 1 is a perspective view of the top of one embodiment of a two-cylinder head of the present invention.
Figure 2:
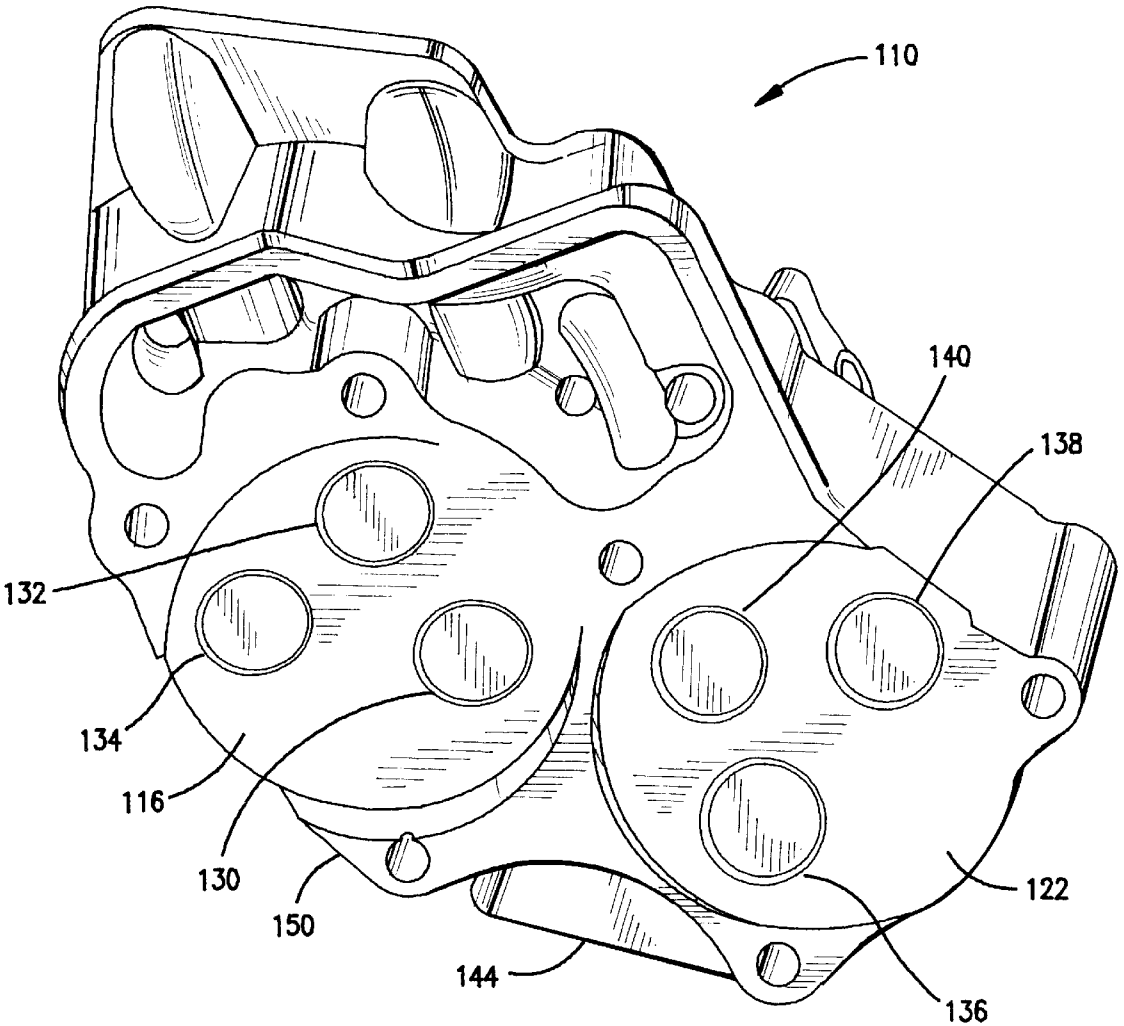
FIG. 2 is a perspective view of the bottom of the two-cylinder head illustrated in FIG. 1.
Figure 3:
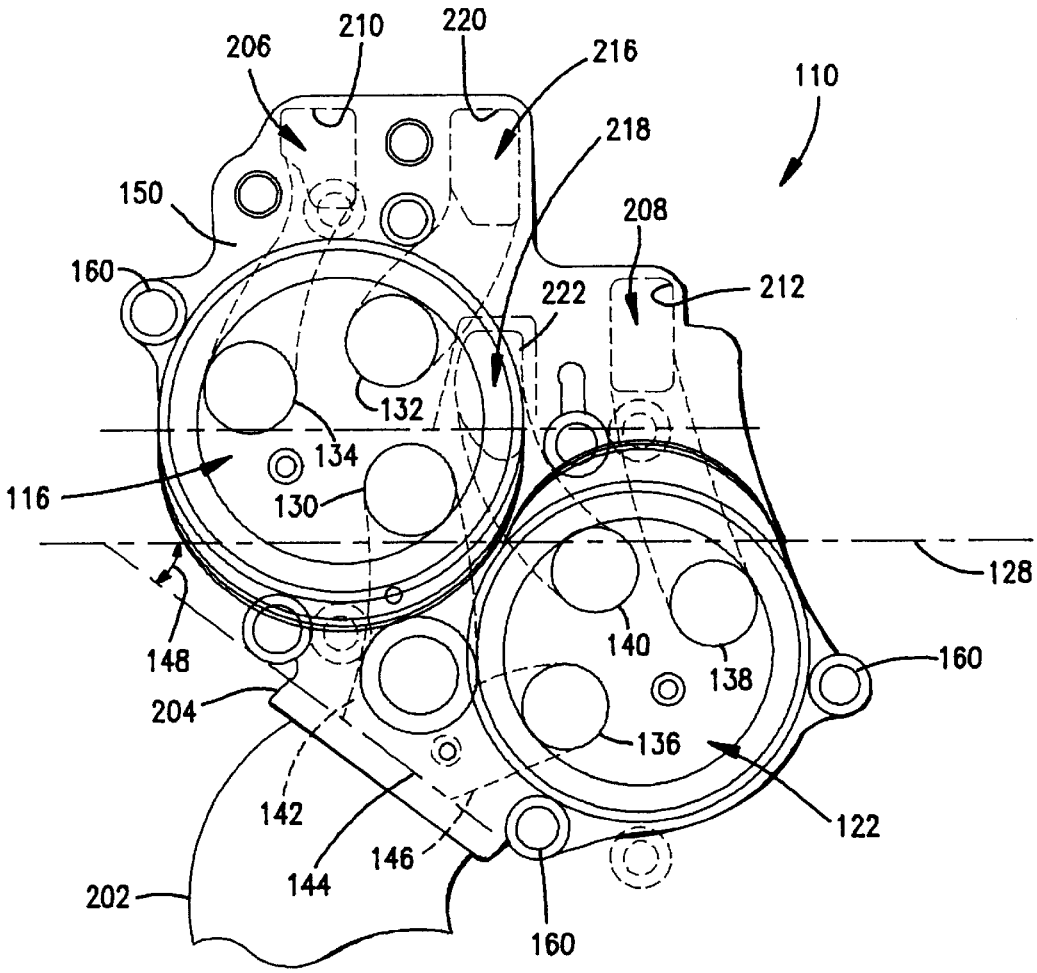
FIG. 3 is a view of the bottom of the two-cylinder head illustrated in FIG. 2 with the valves removed.
Figure 4:
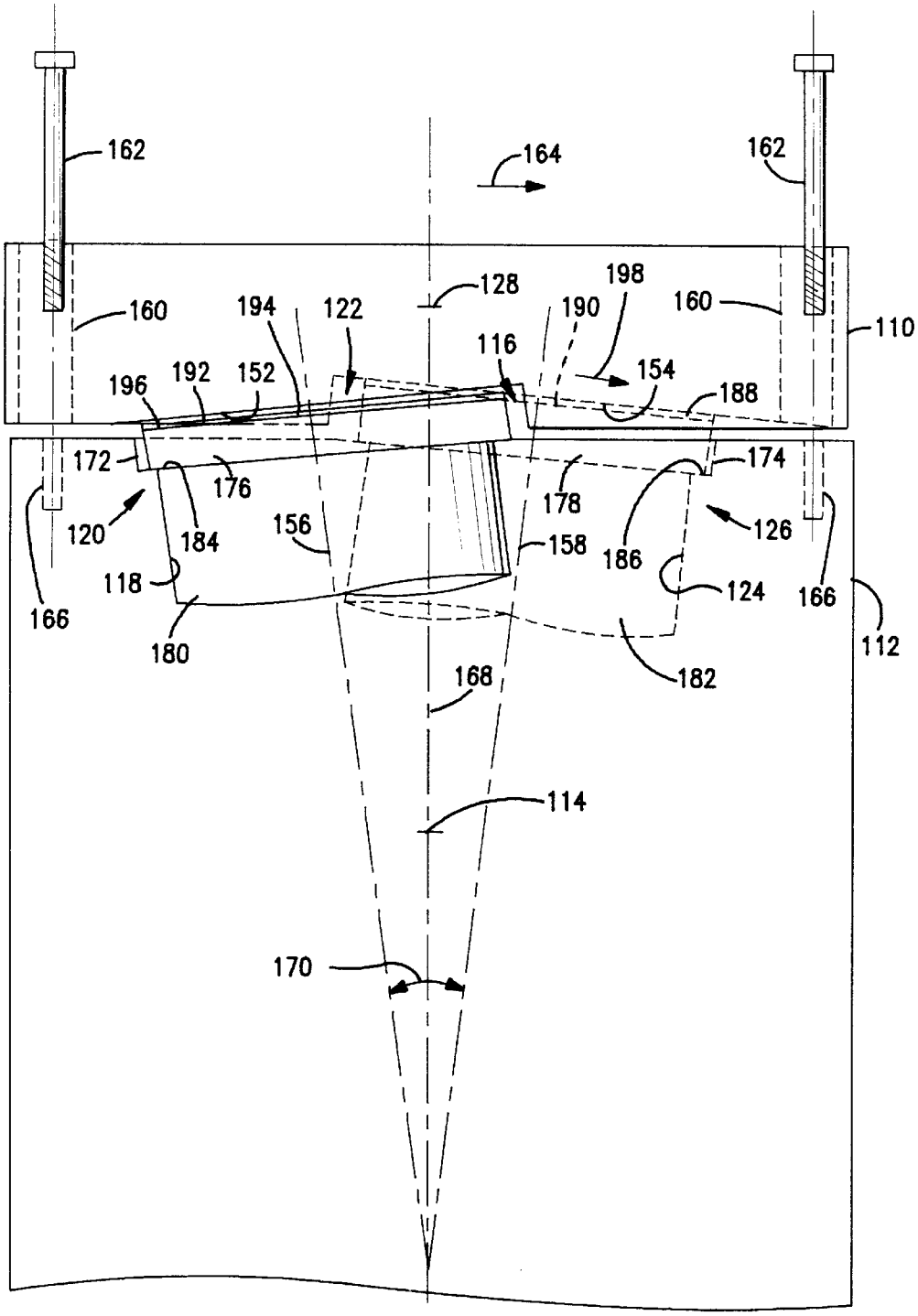
FIG. 4 is a diagrammatic illustration of an internal combustion engine including the two-cylinder head of FIGS. 1 to 3 and an engine block prior to attachment of the head to the block.
Figure 5:
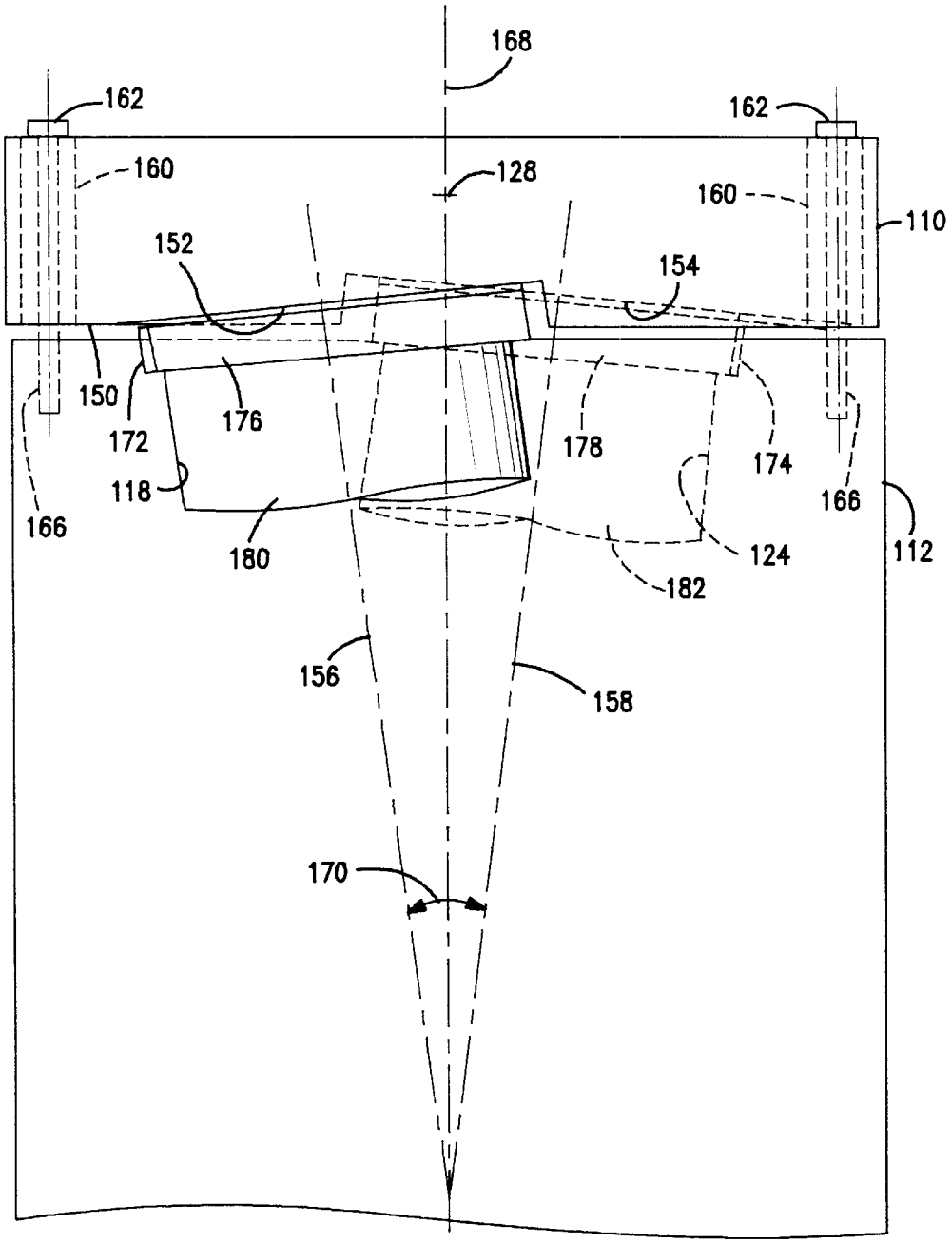
FIG. 5 is a diagrammatic illustration of the internal combustion engine of FIG. 4 after attachment of the head to the block.

The embodiment of this invention which is illustrated in the drawings is particularly suited for achieving the objects of this invention. FIGS. 1 to 3 illustrate one embodiment of a two-cylinder head of the present invention for use with a direct fuel injected diesel internal combustion engine. FIGS. 4 and 5 are diagrammatic illustrations of the two-cylinder head of FIGS. 1 to 3 and an engine block of such internal combustion engine. FIGS. 1 to 5 depict a two-cylinder head 110 which is structured and arranged for attachment to a narrow vee-type engine block 112 having an engine centerline 114 which extends from the front of the engine block to the rear of the engine block. The engine centerline 114 is parallel to a conventional crankcase centerline, not shown. The head 110 includes a first liner flange counterbore 116 structured and arranged to cover a first cylinder 118 of a first bank 120 of the engine block 112, and a second liner flange counterbore 122 structured and arranged to cover a second cylinder 124 of a second bank 126 of the engine block 112. In this manner, the two-cylinder head 110 spans the two adjacent cylinders 118 and 124 of respective opposite banks 120 and 126. In the embodiment illustrated in FIGS. 1 to 5, the first bank 120 and the second bank 126 each include one cylinder 118 and 124, respectively. As will be evident hereinafter, bank 120 can include additional cylinders 118 in line with the cylinder 118 illustrated in FIGS. 1 to 5, and bank 126 can have additional cylinders 124 in line with the cylinder 124 illustrated in FIGS. 1 to 5. A respective two-cylinder head 110 will be associated with each pair of cylinders 118 and 124 as described herein. Cylinders 118 and 124 are arranged in a narrow vee-type engine configuration to minimize the axial distance between cylinders. Without limitation, a narrow vee-type engine is generally considered to have a bank angle of 25° or less.

The first liner flange counterbore 116 is staggered relative to the second liner flange counterbore 122 along a head centerline 128, and the first liner flange counterbore 116 and second liner flange counterbore 122 overlap the head centerline 128, as illustrated in FIGS. 3 to 5. The head centerline 128 will be parallel to the engine centerline 114 when the head is attached to the engine block.

The first liner flange counterbore of the present invention includes a first base which comprises front ports, and the second liner flange counterbore of the present invention includes a second base which comprises second ports which are symmetrically opposite the first ports. At least one first exhaust passage is provided which extends from a first port to an exhaust manifold mounting face and at least one second exhaust passage is provided which extends from a second port to such exhaust manifold mounting face. For example, in the embodiment of FIGS. 1 to 3, the first liner flange counterbore 116 includes a first exhaust port 130 and a first pair of intake ports 132 and 134, and the second liner flange counterbore 122 includes a second exhaust port 136 and a second pair of intake ports 138 and 140. With reference to FIG. 3, the ports 130, 132 and 134 are a mirror image of the ports 136, 138 and 140, respectively, in relation to the head centerline 128; that is, ports 130, 132 and 134 are symmetrically opposite respective ports 136, 138 and 140. A first exhaust passage 142 extends through the body of the two-cylinder head 110 from the first exhaust port 130 to an exhaust manifold mounting face 144, and a second exhaust passage 146 extends through the body of the two-cylinder head 110 from the second exhaust port 136 to the exhaust manifold mounting face 144. The exhaust manifold mounting face 144 extends at an angle 148 relative to the head centerline 128. Although not necessary, in the embodiment of FIGS. 1 to 3 the passages 142 and 146 merge upstream of the mounting face 144. Alternatively, two distinct passages 142 and 146 may be provided.

By providing the mirror image pattern for the exhaust and intake ports, in combination with the angular orientation of the exhaust manifold mounting face, it is possible to position the exhaust manifold mounting face 144 as close as possible to the pair of exhaust ports 130 and 136 and thereby improve the heat transfer characteristics between the two-cylinder head 110 and the cooling jacket (not shown) of the engine block 112 by reducing heat transfer to the cooling jacket. As a practical matter, the length of the exhaust passages 142 and 146 will be minimized to thereby reduce heat rejection to the water jacket by arranging the exhaust ports, and angularly orienting the exhaust manifold mounting faces, as described herein, thereby positioning the exhaust manifold mounting face as close to the exhaust valve pair as possible. In the embodiment illustrated in FIG. 3, exhaust manifold mounting face 144 is at an extreme angle relative to the head centerline as contrasted with a conventional exhaust manifold mounting face which is typically parallel to the head centerline. For example, by way of example, and without limitation, the angle 148 in the embodiment of FIGS. 1–5 is in excess of 30°.

In the embodiment of FIGS. 1 to 5, the two-cylinder head 110 includes a head/block joint surface 150 which is structured and arranged so as to extend in a horizontal plane when the head is attached to the engine block 112 as illustrated in FIGS. 4 and 5. In such embodiment, a first base 152 of the first liner flange counterbore 116 and a second base 154 of the second liner flange counterbore 122 are provided which are structured and arranged to be perpendicular, respectively, to a first axis 156 of the first cylinder 118 and a second axis 158 of the second cylinder 124, when the head 110 is attached to the engine block 112 as illustrated in FIG. 5.

The two-cylinder head of the present invention includes means for attaching the head to an engine block so that when the head is attached to the block substantially all attaching forces are substantially equally distributed between a first liner flange of a first liner extending into a first engine cylinder, and a second liner flange of a second liner extending into a second engine cylinder. Such attaching means may comprise means for simultaneously laterally shifting a first liner flange counterbore relative to a first cylinder and a second liner flange counterbore relative to a second cylinder as the two-cylinder head is being attached to the engine block. Such lateral shifting will generally be in a direction transverse to the head centerline. For example, in the embodiment illustrated in FIGS. 1 to 5, the lateral shifting means may comprise a plurality of head bolt apertures 160 which extend through the two-cylinder head 110. Apertures 160 are structured and arranged to have sufficient clearance relative to head bolts 162 to permit the lateral shift of the two-cylinder head relative to the engine block as the head is being attached to the engine block. To this end, the diameter of the head bolts 162 is sufficiently less than the diameter of apertures 160 to provide the degree of tolerance required to permit the two-cylinder head 110 to shift laterally in direction 164 relative to bolts 162 and head 112 as the bolts are being screwed into the apertures 166 of the head; that is, to shift in direction 164 from the position depicted in FIG. 4 to the position depicted in FIG. 5. The axis of each aperture 160 is perpendicular to the head/block joint surface 150 and parallel to the vertical axis 168 of the engine block 112.

In the embodiment of FIGS. 1 to 5, the centerlines 156 and 158 of cylinders 118 and 124 are angularly oriented relative to the vertical axis 168 of the engine block 112 to form the bank angle 170. In particular, each cylinder 118 and 124 is rotated a transverse angle equal to half of the bank angle 170 relative to vertical axis 168. The cylinder centerlines 156 and 158 may be offset from the center of the crankshaft (not shown) to avoid cylinder bore overlap. By structuring bases 152 and 154 of the two-cylinder head 110 so that they are perpendicular to centerlines 156 and 158, respectively, when the head is attached to the engine block bases 152 and 154 will inherently be oriented at an angle relative to the vertical axis 168. The angular orientation of bases 152 and 154 will correspond to the angular orientation of respective counterbores 172 and 174 provided in the engine block 112 to hold respective liner flanges 176 and 178 of cylinder liners 180 and 182 so that they are square relative to respective cylinders 118 and 124. In other words, in order to provide liner flanges which are square relative to the cylinder counterbores into which each is inserted, in the embodiment described herein the cylinder head 110 will include angled liner flange counterbores 116 and 122 having respective bases 152 and 154, and corresponding engine block counterbores 172 and 174 having angled bases 184 and 186, bases 152 and 154 being parallel to respective bases 184 and 186, and perpendicular to the respective centerlines 156 and 158. The angular orientation of base 154 of the liner flange counterbore 122 will facilitate the lateral shifting of the head 110 relative to the block 112 during attachment of the head to the block using the head bolts 162. For example, FIG. 4 illustrates the initial position of the two-cylinder head 110 relative to the engine block 112 prior to tightening of the head bolts 162. It will be noted that the angularly oriented base 154 engages the upper portion of the gasket or seal 188 which is adjacent the angularly oriented upper liner flange surface 190 of cylinder liner flange 178 of cylinder liner 182 which is inserted into cylinder 124. In contrast, there is a gap 192 between the angularly oriented base 152 and the upper portion of the seal 194 which is adjacent the angularly oriented upper flange surface 196 of cylinder liner flange 176 of cylinder liner 180 which is inserted into cylinder 118. As the head bolts 162 are screwed into the threaded engine block apertures 166 to fasten the head to the engine block, the component of the vertical bolt tightening force represented by arrow 198 will act in the direction along the upper liner flange surface 190 to cause the two-cylinder head to slide down the gasket 188 which is sitting upon the ramp provided by the angularly oriented upper flange surface 190 until contact is established between the base 152 and the seal 194 which is sitting upon the upper flange surface 196 at which time the first liner flange counterbore 116 and the second liner flange counterbore 122 will be centered over respective cylinders 118 and 124. The upper flange surface 190 may be slightly higher than the upper flange surface 196, in which case further sliding will occur before the base 152 engages the seal 194. Such sliding will be further facilitated if the friction coefficient between the compression seal 188 and the base 154 is less than about 0.05. It is known that coefficients of friction are a magnitude less than 0.05 for well-oiled, smooth surfaces. Therefore, if the upper surface of the compression seal 188 is well oiled during assembly, the head 110 will easily seat itself equally relative to both cylinder liner flanges 176 and 178 during the tightening of the engine block bolts 162 as illustrated in FIG. 5.

It will be readily apparent to those skilled in the art that to facilitate lateral shifting of the two-cylinder head 110 of FIGS. 1 to 5, adequate clearance will need to be provided between components of the assembly to allow the cylinder head 110 to shift freely in the transverse direction as it centers itself relative to the oppositely sloped upper flange surfaces 190 and 196. For example, lateral shifting is facilitated by providing adequate clearance between (a) the head bolts 162 and head bolt holes 160, (b) the liner flange outer peripheral surface and the cylinder head counterbore, and (c) the valves and the liner flange inner peripheral surface. By providing these features, the cylinder head 110 will readily shift in the transverse direction 164 to center itself about the top surfaces 190 and 196 of the liner flanges 176 and 178. Thus, the head design of the present invention will provide equal load distribution to surfaces 190 and 196 and automatic compensation for tolerances associated with liner counterbore depth and liner height, liner flange thickness and compression seal thickness. As a practical matter, the two-cylinder head of the present invention will satisfactorily cover two adjacent cylinders of opposite banks and provide compensation for tolerances as described herein as long as the head bolt loading effected by tightening vertical head bolts biases the bank angle, provided that adequate clearances are provided to allow lateral shift for adjustment of the head during assembly of the head and engine block. It should be noted that by providing the structure of the present invention, as for example, embodied in FIGS. 1–5, the clamp load which seals the cylinder pressure is provided by the bolts 162 which are installed perpendicular to the head/block joint surface 150 which is adjacent the head/block interface. No substantial load is transferred through this interface, substantially all clamping forces being divided equally between liner flanges 176 and 178.

The configuration described herein permits an injector of a direct fuel injected engine to be located at the center of each cylinder as required so that the axis of each injector will lie parallel to a respective cylinder centerline. In addition, the valve axes may be oriented parallel to their respective cylinder centerlines.

With reference to FIG. 3, it will be noted that the exhaust manifold mounting face 144 extends at an angle 148 relative to head centerline 128 such that only a single exhaust manifold 202 is required, the manifold being attached to the exhaust manifold mounting face in a conventional manner at interface 204. As described hereinafter, if an internal combustion engine is provided which includes a plurality of two-cylinder heads 110, the mounting face 144 of each will be attached to the same exhaust manifold.

In the embodiment depicted in FIGS. 1 to 5 only one intake manifold (not shown) and only one exhaust manifold 202 are required, such manifolds being positioned on opposite sides of the engine to provide air induction/exhaust cross-flow. The two intake ports 132 and 134, and 138 and 140, at each respective cylinder 118 and 124, and the valves associated therewith, will provide the desired air swirl to the cylinder with minimum air pumping loses. To this end, first intake passages 206 and 208 are structured and arranged to provide low, tangential runners between the intake port 134 and swirl port 210, and intake port 138 and swirl port 212, respectively, located at the intake manifold mounting face 214. In addition, second intake passages 216 and 218 are structured and arranged to provide high, downward flowing runners between the intake port 132 and feed port 220, and intake port 140 and feed port 222, respectively, located at the intake mounting face 214.

Figure 6:
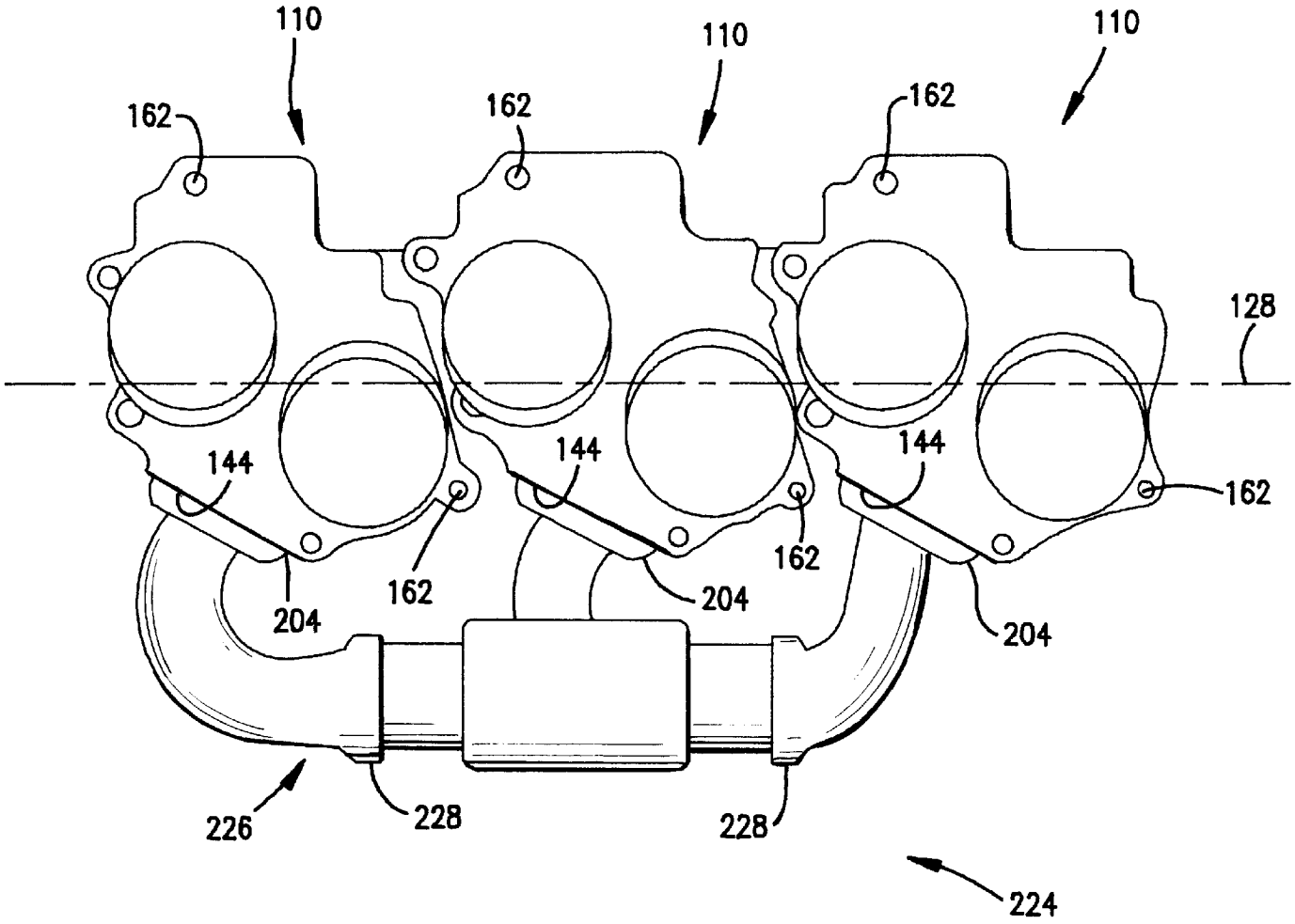
FIG. 6 is a plan view of another embodiment of an internal combination engine of the present invention.

As noted herein, an engine block may be provided having more than two opposing cylinders. If the total number of cylinders is an odd number then the end odd cylinder will be required to include a single cylinder head. When there is more than two opposing cylinders and the total number of cylinders is an even number, then each pair of cylinders will be covered by a two-cylinder head of the present invention. For example, in the embodiment illustrated in FIG. 6, a six cylinder internal combustion engine 224 is illustrated comprising three two-cylinder heads 110 identical to the two-cylinder head 110 of FIGS. 1 to 5. The three two-cylinder heads 110 are configured to nest together as illustrated in FIG. 6, and each two-cylinder head is attached to an engine block 112 by head bolts, which extend through apertures as described herein regarding FIGS. 1 to 5, some of which are identified in FIG. 6 at 162. It will be noted that each exhaust manifold mounting face 144 extends at an angle relative to each head centerline 128 such that only a single exhaust manifold 226 is required, the manifold being attached to each exhaust manifold mounting face in a conventional manner at a respective interface 204. If desired, the manifold 226 may be in the form of a segmented exhaust manifold having conventional slip joints 228 to accommodate thermal expansion. The slip joints, in combination with the angled exhaust manifold mounting faces 144 provide for assembly adjustment to compensate for manufacturing tolerances so that the very tight tolerances ordinarily required between the manifold faces and slip joint centers are not necessary. In the embodiment depicted in FIG. 6 only one intake manifold (not shown) and only one exhaust manifold 226 are required, such manifolds being positioned on opposite sides of the engine to provide air induction/exhaust crossflow as described herein.

Figure 7:
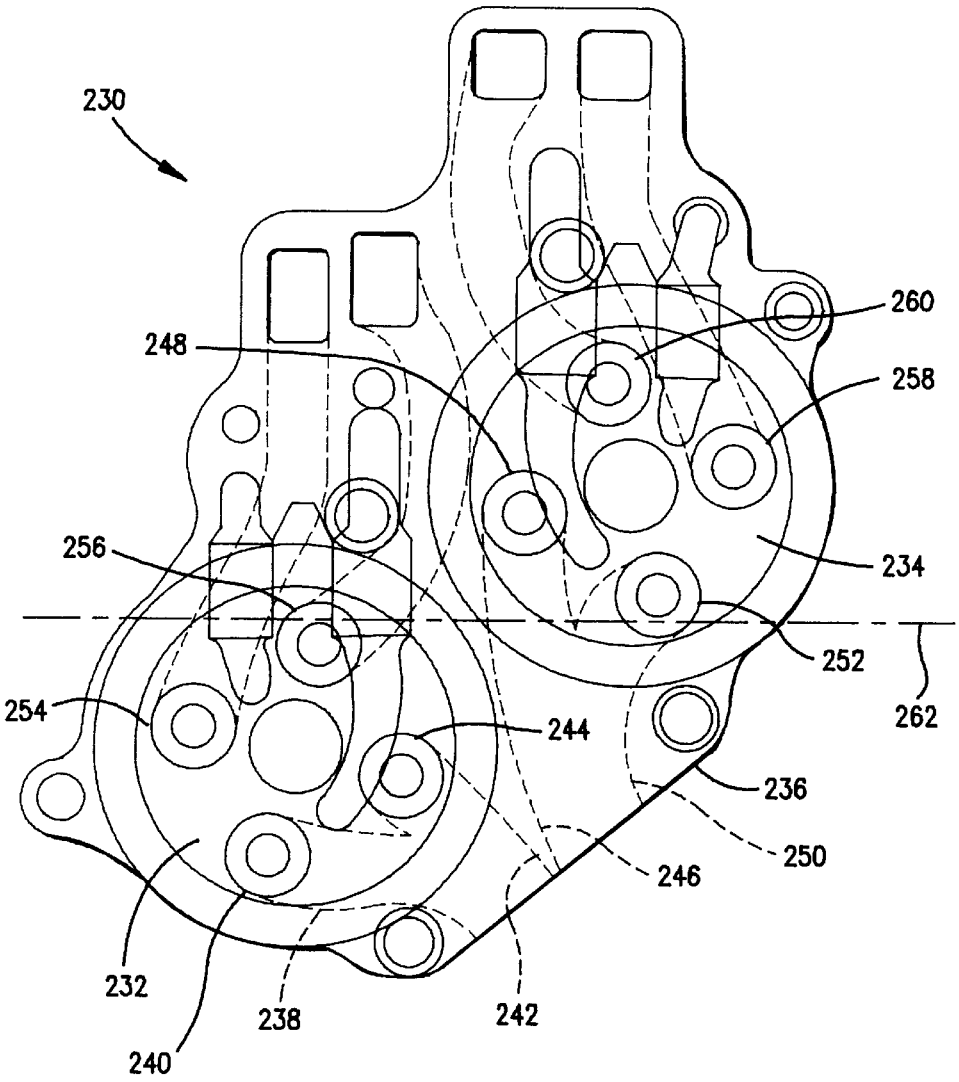
FIG. 7 is a view of the top of an alternative two-cylinder head embodying the present invention with the valves removed.

In the embodiment of FIGS. 1 to 6, each two-cylinder head 110 includes one exhaust port and one exhaust passage extending from the exhaust port to an exhaust manifold mounting face. Additional exhaust ports and exhaust passages may be provided if desired. For example, FIG. 7 illustrates a two-cylinder head 230 which includes two liner flange counterbores 232, 234 each of which includes two exhaust ports which communicate with an exhaust manifold mounting face 236. In particular, at liner flange counterbore 232 an exhaust passage 238 extends from an exhaust port 240 to mounting face 236, and an exhaust passage 242 extends from an exhaust port 244 to mounting face 236. Similarly, at liner flange counterbore 234, an exhaust passage 246 extends from an exhaust port 248 to mounting face 236, and an exhaust passage 250 extends from an exhaust port 252 to mounting face 236. Like the embodiment of FIGS. 1 to 6, each liner flange counterbore 232, 234 includes respective intake ports 254, 256 and 258, 260, respectively, which are structured and arranged in a manner similar to the intake ports of the embodiment of FIGS. 1 to 6 to provide the desired air swirl to the cylinder with minimum air pumping loses. Like the embodiment of FIGS. 1 to 6, the exhaust ports 240, 244 and intake ports 254, 256 are a mirror image of exhaust ports 248, 252 and intake ports 258, 260, respectively, in relation to a head centerline 262. The embodiment of FIG. 7 is similar to the embodiment of FIGS. 1 to 6 in all other respects. Although not necessary, the exhaust passages 238 and 242 merge upstream of the mounting face 236. Similarly, exhaust passages 246 and 250 merge upstream of the mounting face 236.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A two-cylinder head structured and arranged for attachment to a vee engine block having an engine centerline extending from a front of said engine block to a rear of said engine block, comprising a first liner flange counterbore structured and arranged to cover a first cylinder of a first bank of said engine block, and a second liner flange counterbore structured and arranged to cover a second cylinder of a second bank of said engine block, when said two-cylinder head is attached to an engine head, said first liner flange counterbore being staggered relative to said second liner flange counterbore along a head centerline, said first liner flange counterbore and said second liner flange counterbore overlapping said head centerline, said first liner flange counterbore including one or more first exhaust ports and a first pair of intake ports, and said second liner flange counterbore including one or more second exhaust ports and a second pair of intake ports, said one or more first exhaust ports and said first pair of intake ports being a mirror image of said one or more second exhaust ports and said second pair of intake ports, respectively, a respective first exhaust passage extending from each first exhaust port to an exhaust manifold mounting face, and a respective second exhaust passage extending from each second exhaust port to said exhaust manifold mounting face, said exhaust manifold mounting face extending at an angle to said head centerline.

2. The two-cylinder head of claim 1, wherein said exhaust manifold mounting face is positioned as close as possible to said one or more first exhaust port and said one or more second exhaust port.

3. The two-cylinder head of claim 1, further including a head/block joint surface structured and arranged so as to extend in a horizontal plane when said two-cylinder head is attached to said engine block, and wherein a first base of said first liner flange counterbore and a second base of said second liner flange counterbore are structured and arranged to be perpendicular, respectively, to a first axis of said first cylinder and a second axis of said second cylinder, when said two-cylinder head is attached to said engine block, said first axis and said second axis being oriented at a respective first angle and second angle relative to a vertical axis of said engine block.

4. The two-cylinder head of claim 1, further including means for attaching said two-cylinder head to said engine block so that when said two-cylinder head is attached to said engine block substantially all attaching forces are substantially equally distributed to a first liner flange of a first liner extending into said first cylinder and a second liner flange of a second liner extending into said second cylinder.

5. The two-cylinder head of claim 4, wherein said attaching means comprises means for simultaneously laterally shifting, in a direction transverse to said head centerline, said first liner flange counterbore relative to said first cylinder, and said second liner flange counterbore relative to said second cylinder, as said two-cylinder head is being attached to an engine block.

6. The two-cylinder head of claim 5, wherein said laterally shifting means comprises a plurality of head bolt apertures extending through said two-cylinder head, said plurality of apertures being structured and arranged to have sufficient clearance relative to head bolts, extended through respective of said head bolt apertures and threaded into said engine block during attachment of said head to said engine block, to allow lateral shift of said head relative to said engine block as said head bolts are being threaded into said engine block.

7. The two-cylinder head of claim 6, further including a head/block joint surface structured and arranged so as to extend in a horizontal plane when said two-cylinder head is attached to said engine block, and wherein a first base of said first liner flange counterbore and a second base of said second liner flange counterbore are structured and arranged to be perpendicular, respectively, to a first axis of said first cylinder and a second axis of said second cylinder when said two-cylinder head is attached to said engine block, said first axis and said second axis being oriented at a respective first angle and second angle relative to a vertical axis of said engine block.

8. The two-cylinder head of claim 7, wherein each aperture of said plurality of head bolt apertures is perpendicular to said head/block joint surface.

9. The two-cylinder head of claim 3, further including a plurality of head bolt apertures extending through said two-cylinder head, said plurality of apertures being structured and arranged to have sufficient clearance relative to head bolts, extended through respective of said head bolt apertures and threaded into said engine block during attachment of said head to said engine block, to allow lateral shift of said head relative to said engine block as said head bolts are being threaded into said engine block.

10. The two-cylinder head of claim 9, wherein each aperture of said plurality of head bolt apertures is perpendicular to said head/block joint interface surface.

11. The two-cylinder head of claim 10, wherein said exhaust manifold mounting face is positioned as close as possible to said one or more first exhaust port and said one or more second exhaust port.

12. The two-cylinder head of claim 8, wherein said exhaust manifold mounting face is positioned as close as possible to said one or more first exhaust port and said one or more second exhaust port.

13. An internal combustion engine which comprises an engine block and at least one two-cylinder head attached thereto, said engine block having a crankshaft centerline extending from one end of said engine block to an opposite end of said engine block, said engine block comprising at least one first cylinder forming a first bank of said engine block and at least one second cylinder forming a second bank of said engine block, said at least one first cylinder having a first cylinder liner inserted therein, said first cylinder liner having a first liner flange, and said at least one second cylinder having a second cylinder liner inserted therein, said second cylinder liner having a second liner flange, said at least one cylinder head comprising:

a first liner flange counterbore structured and arranged to cover said first cylinder, and a second liner flange counterbore structured and arranged to cover said second cylinder, said first liner flange counterbore being staggered relative to said second liner flange counterbore along said crankshaft centerline, said first liner flange counterbore and said second liner flange counterbore overlapping said crankshaft centerline, said first liner flange counterbore including one or more first exhaust ports and a first pair of intake ports, and said second liner flange counterbore including one or more second exhaust ports and a second pair of intake ports, said one or more first exhaust ports and said first pair of intake ports being a mirror image of said one or more second exhaust ports and said second pair of intake ports, respectively, a respective first exhaust passage extending from each first exhaust port to an exhaust manifold mounting face, and a respective second exhaust passage extending from each second exhaust port to said exhaust manifold mounting face, said exhaust manifold mounting face extending at an angle to said crankcase centerline.

14. The internal combustion engine of claim 13 further including a head/block joint interface extending in a horizontal plane, and wherein a first base of said first liner flange counterbore and a second base of said second liner flange counterbore are structured and arranged to be perpendicular, respectively, to a first axis of said first cylinder and a second axis of said second cylinder, said first axis and said second axis being oriented at a respective first angle and second angle relative to a vertical axis of said engine block, said vertical axis being perpendicular to said horizontal plane.

15. The internal combustion engine of claim 14 wherein said at least one two-cylinder head includes a plurality of head bolt apertures extending through said two-cylinder head, said plurality of head bolt apertures being structured and arranged to have sufficient clearance relative to head bolts, extended through respective of said head bolt apertures and threaded into said engine block during attachment of said head to said engine block, to allow lateral shift of said head relative to said engine block as said head bolts are threaded into said engine block.

16. The two-cylinder head of claim 15, wherein each aperture of said plurality of head bolt apertures is perpendicular to said head/block joint interface.

17. The internal combustion engine of claim 13 wherein said at least one two-cylinder head comprises a plurality of two-cylinder heads, each two-cylinder head being attached to the same exhaust manifold at a respective exhaust manifold mounting face.

18. The internal combustion engine of claim 17 wherein said exhaust manifold comprises one or more slip joints.

19. A two-cylinder head structured and arranged for attachment to a vee engine block, said two-cylinder head having a central horizontal axis extending from one head end to an opposite head end and a central vertical axis which is perpendicular to said horizontal axis, a first counterbore being staggered relative to a second counterbore relative to said horizontal axis, said first and second counterbores overlapping said horizontal axis, a first base of said first counterbore comprising first ports, and a second base of said second counterbore comprising second ports which are opposite said first ports, at least one first exhaust passage extending from a first port to an exhaust manifold mounting face and at least one second exhaust passage extending from a second port to said exhaust manifold mounting face, a head/block joint surface of the cylinder head which extends in a plane which is parallel to said horizontal axis, said first base extending in a first base plane and said second base extending in a second base plane, said first and second base planes being structured and arranged so that said first base plane is perpendicular to a first axis of a first cylinder of said engine block, and said second base plane is perpendicular to a second axis of a second cylinder of said engine block, when said two-cylinder head is attached to said engine block, said first axis and said second axis extending in opposite directions at a respective angle relative to said vertical crankcase axis of said engine block when said two-cylinder head is attached to said engine block.

20. The two-cylinder head of claim 19, further including a plurality of head bolt apertures extending through said two-cylinder head, said plurality of head bolt apertures being structured and arranged to have sufficient clearance relative to head bolts, extended through respective of said head bolt apertures and threaded into said engine block during attachment of said head to said engine block, to allow lateral shift of said head relative to said engine block as said head bolts are threaded into said engine block.

* * * * *